US009989059B2

(12) United States Patent
Karim et al.

(10) Patent No.: US 9,989,059 B2
(45) Date of Patent: Jun. 5, 2018

(54) NOISE-REDUCTION MECHANISM FOR OIL PUMP

(71) Applicant: FORD GLOBAL TECHNOLOGIES, LLC, Dearborn, MI (US)

(72) Inventors: Ahsanul Karim, Canton, MI (US); Abhijyoth Vempati, Farmington, MI (US); Abdelkrim Zouani, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 578 days.

(21) Appl. No.: 14/245,144

(22) Filed: Apr. 4, 2014

(65) Prior Publication Data

US 2015/0285250 A1 Oct. 8, 2015

(51) Int. Cl.

| | |
|---|---|
| ***F04C 29/06*** | (2006.01) |
| ***F04C 2/344*** | (2006.01) |
| ***F04C 15/00*** | (2006.01) |
| ***F04C 2/324*** | (2006.01) |
| *F04C 14/22* | (2006.01) |

(52) U.S. Cl.

CPC ..... *F04C 29/065* (2013.01); *F04C 2/324* (2013.01); *F04C 2/3441* (2013.01); *F04C 15/0049* (2013.01); *F04C 14/226* (2013.01); *F04C 29/061* (2013.01); *F04C 2270/13* (2013.01)

(58) Field of Classification Search

CPC ..... F04C 29/065; F04C 29/061; F04C 29/06; F04C 29/063; F04C 29/066; F04C 29/068; F04C 2/324; F04C 15/0049; F04C 2/3441; F04C 14/226; F04C 2270/13; F04C 2270/14; F01M 1/02; F04B 53/001; F04B 39/0027; F04B 39/0033; F04B 39/0038; F04B 39/0044; F04B 39/005; F04B 39/0055; F04B 39/0061; F04B 39/0066; F01C 21/006; F16L 55/04; F02M 55/04; F04D 29/663; F04D 29/664; F04D 29/665

USPC ..... 417/312; 138/26; 181/250, 256, 273, 181/276; 36/66

See application file for complete search history.

(56) References Cited

U.S. PATENT DOCUMENTS

| | | | | | |
|---|---|---|---|---|---|
| 3,912,631 | A * | 10/1975 | Turman | B01D 27/07 | 210/136 |
| 4,314,621 | A * | 2/1982 | Hansen | F16L 55/0336 | 138/30 |
| 5,101,930 | A * | 4/1992 | Fargo | F16L 55/0332 | 181/233 |
| 5,426,270 | A * | 6/1995 | Wheeler | F16L 55/0332 | 181/221 |
| 5,705,777 | A * | 1/1998 | Flanigan | F01N 1/24 | 181/252 |
| 5,759,217 | A * | 6/1998 | Joy | B01D 46/0039 | 55/320 |

(Continued)

FOREIGN PATENT DOCUMENTS

JP 2006009807 A 1/2006

*Primary Examiner* — Patrick Hamo
(74) *Attorney, Agent, or Firm* — LeClairRyan

(57) ABSTRACT

A noise-reduction mechanism is coupled to a portion of an oil-pump system and includes various tunable components that are configurable to affect specific frequency ranges of noise within the system. The mechanism includes a series of channels that are coupled to a portion of the oil-pump system (e.g., outlet tube) and are coupled to a reservoir.

18 Claims, 6 Drawing Sheets

(56) References Cited

U.S. PATENT DOCUMENTS

| | | | | |
|---|---|---|---|---|
| 6,568,540 | B1 * | 5/2003 | Holzmann | B01D 29/016 210/445 |
| 6,745,798 | B2 | 6/2004 | Kilgore | |
| 6,840,746 | B2 * | 1/2005 | Marshall | F04B 39/005 181/233 |
| 7,552,797 | B2 * | 6/2009 | Luttig | F01N 1/003 181/250 |
| 2003/0234138 | A1 * | 12/2003 | Bagga | F02M 55/04 181/233 |
| 2005/0247609 | A1 * | 11/2005 | Laing | B01D 61/08 210/109 |
| 2007/0227476 | A1 * | 10/2007 | Tsuruta | F01M 1/16 123/41.86 |
| 2012/0020807 | A1 | 1/2012 | Fernholz et al. | |
| 2012/0128518 | A1 * | 5/2012 | Yamada | F04C 18/0215 418/55.6 |
| 2012/0325356 | A1 | 12/2012 | Chatfield et al. | |

* cited by examiner

NOISE-REDUCTION MECHANISM FOR OIL PUMP

BACKGROUND

Oil pumps circulate oil to various components of an engine to assist with friction reduction and cooling. During circulation, the oil can experience changes in pressure based on various factors, such as where the oil is in the circulation cycle and the type of pump utilized. In some instances, rapid changes in oil pressure can cause undesirable engine noise, such as a "whining" sound.

SUMMARY

An embodiment of the present invention is directed to a noise-reduction mechanism for an oil pump. The noise-reduction mechanism attaches to the oil-pump outlet tube through which oil is pumped and functions to reduce the rate of oil-pressure change.

Embodiments of the invention are defined by the claims below, not this summary. A high-level overview of various aspects of the invention is provided here for that reason, to provide an overview of the disclosure, and to introduce a selection of concepts further described below in the detailed description. This summary is not intended to identify key or essential features of the claimed subject matter, nor is it intended to be used as an aid in isolation to determine the scope of the claimed subject matter.

BRIEF DESCRIPTION OF THE DRAWINGS

Illustrative embodiments of the present invention are described in detail below with reference to the attached figures, which are incorporated herein by reference, wherein.

DETAILED DESCRIPTION

The subject matter of embodiments of the present invention is described with specificity herein to meet statutory requirements. But the description itself is not intended to necessarily limit the scope of claims. Rather, the claimed subject matter might be embodied in other ways to include different elements or combinations of elements similar to the ones described in this document, in conjunction with other present or future technologies.

As indicated in other parts of this specification, the present invention is directed to a noise-reduction device for any noisy fixed or variable-displacement oil pump. The noise-reduction device attaches to the oil-pump outlet tube through which oil is pumped out and helps to control the rate at which the oil pressure changes.

Figure 1:
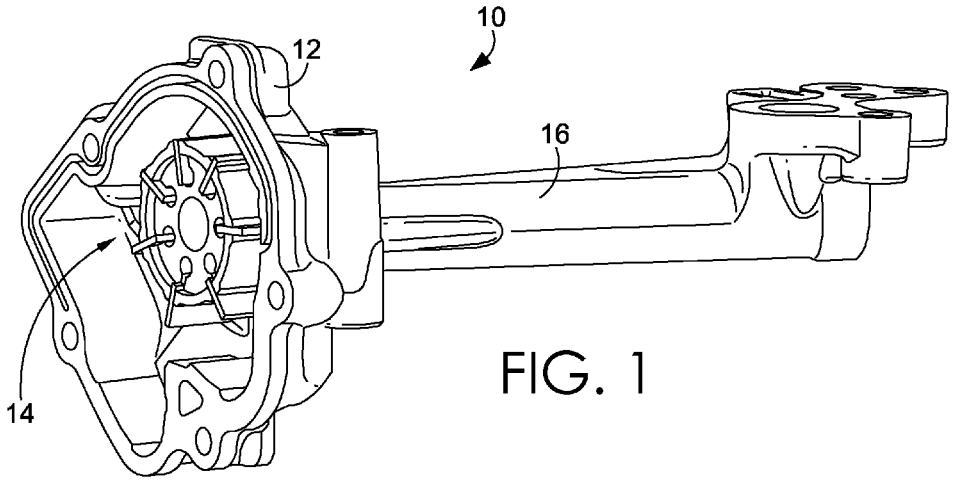
FIG. 1 depicts an exemplary variable-displacement oil pump environment in accordance with an embodiment of the present invention.

Referring now to FIG. 1, a portion of an oil-pump arrangement 10 is depicted, including an oil-pump housing 12, an inlet region 14, and an outlet-port tube 16. The oil-pump housing 12 functions to encase an oil pump, and in one embodiment, the oil pump is a variable-displacement oil pump. For exemplary purposes, a cross-section view of a type of variable-displacement oil pump is shown in FIG. 2.

Figure 2:
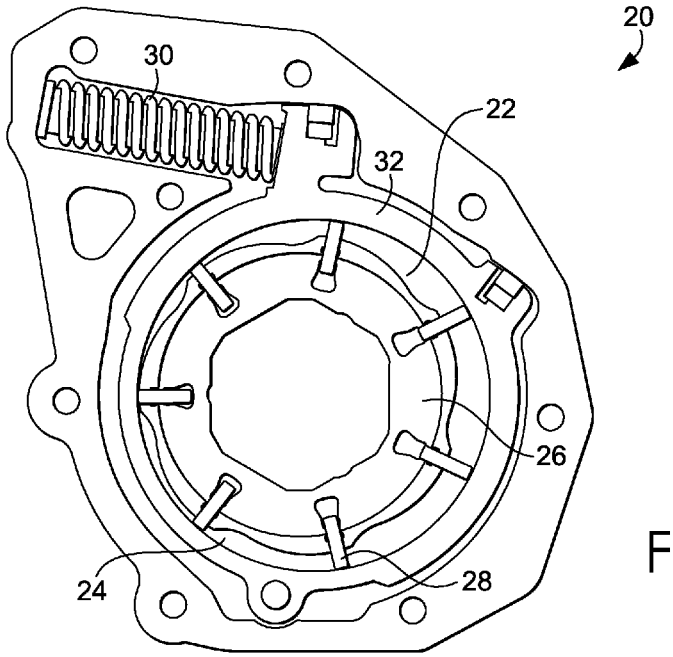
FIG. 2 depicts an exemplary variable-displacement oil pump (VDOP) in accordance with an embodiment of the present invention.

Referring briefly to FIG. 2, the variable-displacement oil pump 20 includes an inlet port 22, an outlet port 24, a rotor 26 having sliding vanes 28, a spring 30 (e.g., solenoid actuated), and a slider mechanism 32. The rotor 26 rotates (such as by way of a shaft drive) causes oil to be sucked into the pump 20 through the inlet and pushed out of the pump through the outlet 24. The spring 30 moves the slider mechanism 32 and changes the eccentricity of the rotor 26 which determines the oil-pressure level at the pump output. The outlet 24 is in fluid communication with the outlet-port tube 16 illustrated in FIG. 1.

Figure 3:
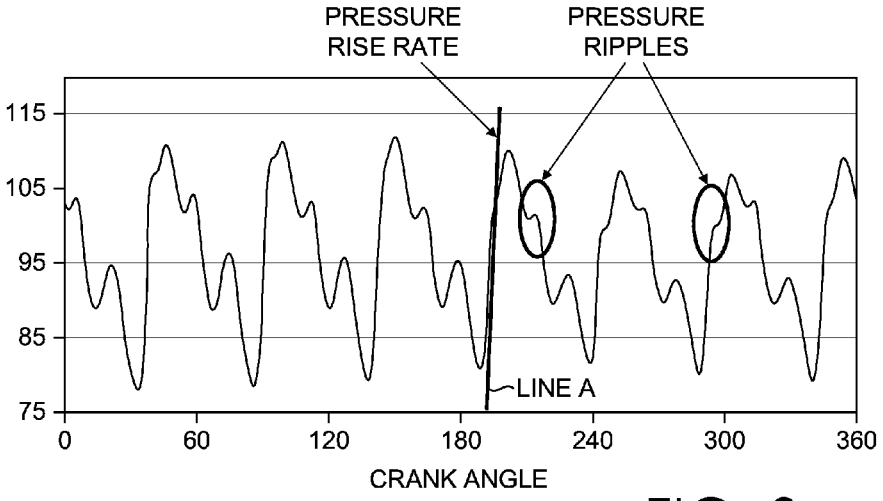
FIG. 3 depicts a graph showing changes in pressure rates versus crank angle in a noisy oil pump which does not include a noise-reduction device in accordance with an embodiment of the present invention.
Figure 4:
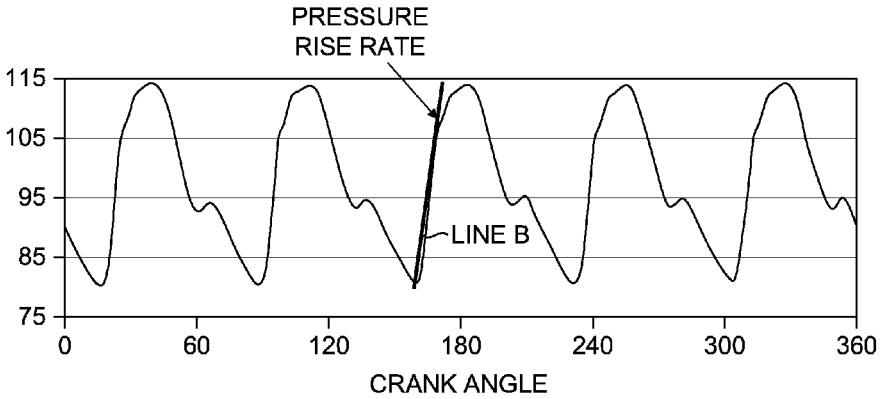
FIG. 4 depicts a graph showing changes in pressure rates versus crank angle in a quiet oil pump which may or may not include a noise-reduction device in accordance with an embodiment of the present invention.

Because of the relative "straight" design of the vanes 28, variable-displacement oil pumps often create rapid transitions from low pressure to peak pressure and more ripples in the oil pressure pulses. For instance, FIG. 3 depicts a line graph of pressure readings against crank angles in a system that utilizes a variable-displacement oil pump (or some other noisy pump) and that does not include the present invention. In comparison, FIG. 4 depicts a line graph of pressure readings against crank angles in a system that utilizes a quiet oil pump. A comparison of Line A in FIG. 3 and Line B in FIG. 4 depicts a more rapid transition from lower to peak pressure in the noisy oil pump (e.g., variable-displacement oil pump), absent the present invention. In some cases, the more rapid increase in oil pressure associated with a noisy oil pump translates into excessive whine noises at the critical pump orders (i.e. harmonics of the primary pump order).

Figure 5A:
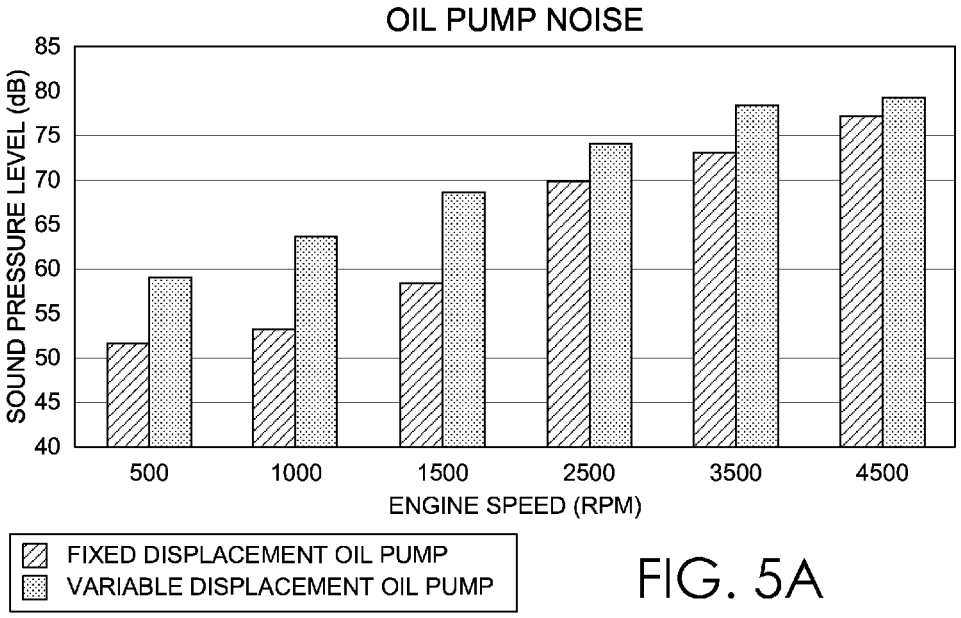
FIG. 5A depicts a graph that compares oil-pump noise of a variable-displacement oil pump and a fixed-displacement oil pump neither of which includes a noise-reduction device in accordance with an embodiment of the present invention.
Figure 5B:
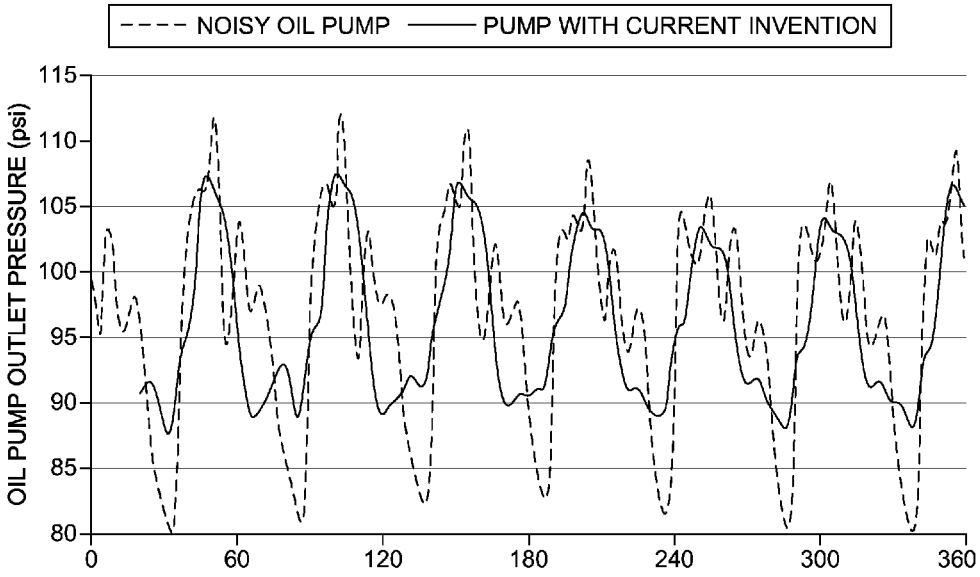
FIG. 5B depicts a graph showing changes in pressure rates versus crank angle in an originally noisy oil pump after adding a noise-reduction device in accordance with an embodiment of the present invention.

Referring briefly to FIG. 5A, a bar graph is depicted that shows a comparison of noise levels of a noisier oil pump (e.g., variable-displacement oil pump) and a quieter oil pump (e.g., some fixed-displacement oil pumps). FIG. 5A illustrates that the overall noise level of a noisy oil pump is often 5 to 10 dB higher when the pump does not include the present invention. For illustrative purposes, FIG. 5B includes a line graph showing pressure readings against crank angle in both a noisy pump that has not been modified (FIG. 3) and a noisy pump that has been modified to include an embodiment of the present invention. FIG. 5B illustrates that the present invention can reduce the rate of pressure increase and ripples.

Figure 6A:
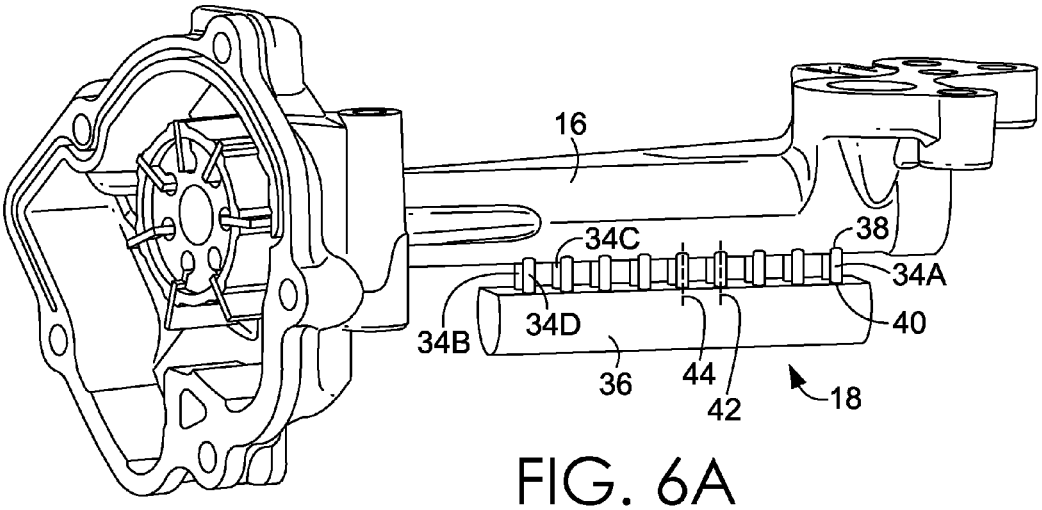
FIG. 6A depicts a VDOP that is coupled with a noise-reduction device in accordance with an embodiment of the present invention.

Referring now to FIG. 6A, an embodiment of the present invention is depicted in which a noise-reduction mechanism 18 is coupled to the outlet tube 16. The noise-reduction mechanism, or parts thereof, might also be referred to as a "muffler" in this description. The noise-reduction mechanism includes a series of communication channels 34A-D coupled directly to a reservoir 36. Although only a handful of the channels are labeled with numerical identifiers in the figures, embodiments of the invention are not limited to those labeled channels. In addition, although FIG. 6A depicts the communication channels as tubular structures, in other embodiments the communication channels are formed by drilling holes in an at least partially solid block.

In an embodiment of the present invention, each of the channels 34A-D includes a respective first end 38 for communication with an oil-pump outlet tube 16 and a respective second end 40 for communication with the reservoir 36. In addition, in FIG. 6A, the channels 34 are arranged such that axes 42 and 44 of the channels are substantially parallel to one another. However, the communication channels might be angled relative to one another in other embodiments of the present invention to tune the operation of the noise-reduction device. The reservoir 36 includes a hollow tubular structure that is capped at both ends.

Figure 6B:
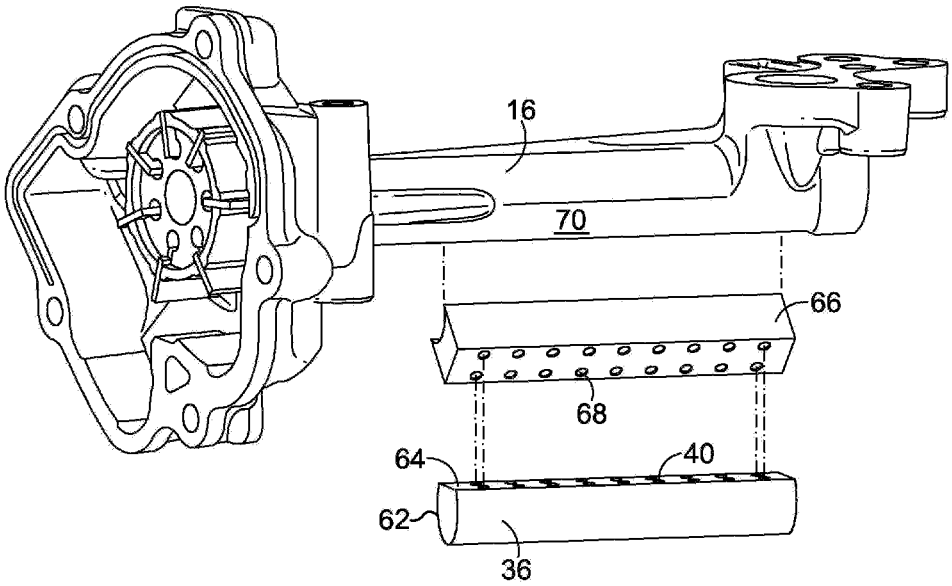
FIG. 6B depicts an exploded view of a VDOP and a noise-reduction device in accordance with an embodiment of the present invention.
Figure 7:
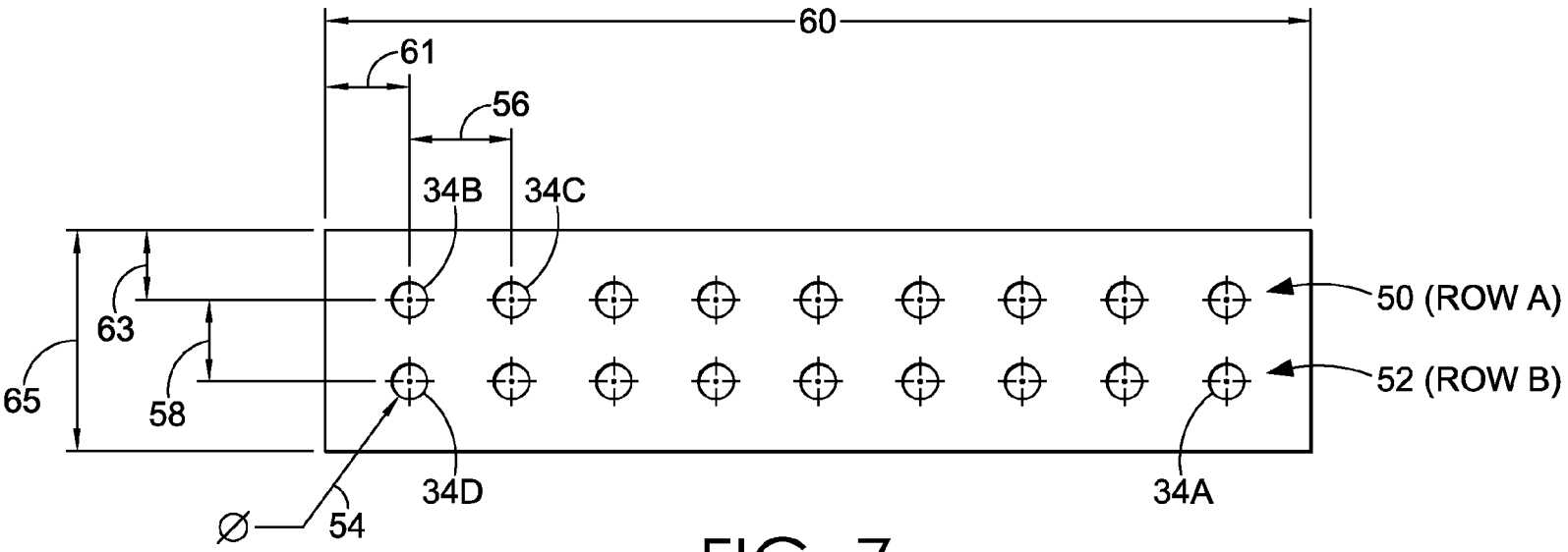
FIG. 7 depicts a plan view of a noise-reduction device in accordance with an embodiment of the present invention.

In operation, the channels 34A-D and the reservoir 36 function to reduce noise originating from oil pulsations. As depicted in FIGS. 6A, 6B, and 7, in one embodiment the channels include a first row (e.g., Row A-50) and a second row (e.g., ROW B-52) that might be substantially parallel to one another. In addition, the volume of the reservoir, as well as the length, diameter, number, spacing, and orientation of the channels 34A-D are modifiable to tackle specific frequency ranges of noise. In one embodiment, each of the channels 34A-D includes a diameter 54 of about 3.175 mm. In a further embodiment, each channel in the first row (e.g., 34B) is spaced apart from an adjacent channel in the first row (e.g., 34C) by a distance 56 of about 9.21 mm, and is spaced apart from an adjacently aligned channel (e.g., 34D) in the second row by a distance 58 of about 7.41 mm. In addition, a channel 34B that is outermost in a row is spaced apart from an end of the reservoir tube a distance 61 about 7.6 mm. Each channel is spaced apart from an adjacent edge of the reservoir a distance 63 of approximately 6.3 mm. In a further embodiment, the first row of channels includes nine channels, and the second row of channels includes nine channels.

Figure 6C:
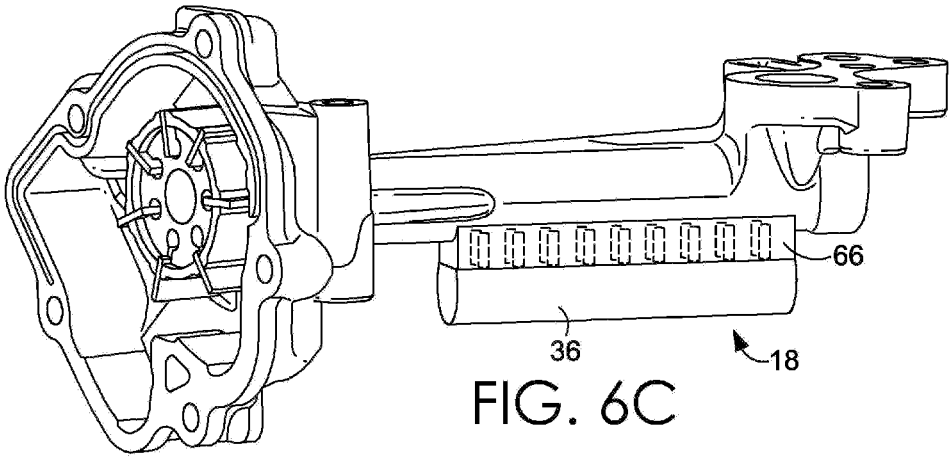
FIG. 6C depicts a VDOP that is coupled with a noise-reduction device in accordance with an embodiment of the present invention.

The reservoir is also tunable to control specific frequency ranges, such as by modifying a tube length 60 and a shape. For instance, in one embodiment, the tube includes a length 60 of approximately 90 mm. In addition, a shape of the reservoir includes a round wall 62 and a flat wall 64 to which the channels are connected. The round wall 62 and flat wall 64 are coupled to form a tube, which is capped on each end. As depicted in FIGS. 6A-6C, the round or curved wall 62 is not a complete circle, but instead includes an arc of a circle, which includes an inside diameter of about 19 mm. In addition, the flat wall 64 includes a width 65 of about 20 mm and a length 60 of about 90 mm.

The noise-reduction device 18 might be coupled to an outlet tube 16 in various manners. For instance, referring to an embodiment depicted in FIGS. 6B and 6C, a block 66 is affixed (e.g., welded) to an underneath side 70 (i.e., surface) of the outlet tube 16. Then, a series of holes (e.g., 68) are drilled from a bottom of the block 66, through the block 66 and through a wall of the outlet tube 16, and in a pattern that corresponds with the hole pattern for the noise-reduction device and with holes drilled in the flat wall 64 of the reservoir 36. The reservoir 36 is then affixed (e.g., welded) to the block 66. The holes (e.g., 68) that are drilled in the block 66 establish a fluid connection between the oil-pump outlet tube and the reservoir 36. For illustrative purposes, FIG. 6C depicts the channels in ghost view to illustrate that the channels are formed in the block 66 when the reservoir 36 is attached.

Many different arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A noise-reduction device for an oil pump having a housing, the housing having an inlet and an elongated outlet having a housing axis extending between the inlet and the elongated outlet, the device comprising:

an elongated reservoir having a pair of capped ends and a reservoir axis extending between said capped ends that is generally aligned with the housing axis of the elongated outlet of the oil pump, said elongated reservoir mounted exteriorly of the elongated outlet; and a plurality of channels, each channel of the plurality of channels including a respective first channel end for communication with the elongated outlet and a respective second channel end that opposes said first end for communication with said elongated reservoir.

2. The noise-reduction device of claim 1, wherein each channel of said plurality of channels includes a diameter of about 3.175 mm to attenuate a noise emanated from the oil pump.

3. The noise-reduction device of claim 1, wherein said plurality of channels forms a first row of channels and a second row of channels, and wherein said first row of channels is substantially parallel to said second row of channels.

4. The noise-reduction device of claim 3, wherein a gap of about 9.21 mm is provided between each channel of said plurality of channels in said first row of channels.

5. The noise-reduction device of claim 3, wherein a gap of about 7.41 mm is provided between each channel of said plurality of channels in said first row of channels and an adjacent channel of said plurality of channels in said second row of channels.

6. The noise-reduction device of claim 3, wherein said first row of channels includes nine channels and said second row of channels includes nine channels.

7. The noise-reduction device of claim 1, wherein the elongated outlet is approximately 90 mm long.

8. The noise-reduction device of claim 1, wherein the elongated outlet includes a round wall and a flat wall, and wherein said channels extend from said flat wall.

9. The noise-reduction device of claim 8, wherein said flat wall includes a width of about 20 mm and a length of about 90 mm.

10. The noise-reduction device of claim 8, wherein a cross section of said round wall includes an arc of a circle, said arc including an inside diameter of about 19 mm.

11. A noise-reduction device for an oil pump having a housing, the housing having an inlet and an elongated outlet having a wall and a housing axis extending between the inlet and the elongated outlet, the device comprising:

an elongated reservoir having capped ends and a reservoir axis extending between said capped ends that is generally aligned with the housing axis of the elongated outlet of the oil pump; and a block having a top wall and a bottom wall, said block mounted exteriorly of the elongated outlet and separating the elongated reservoir from the elongated outlet, said block including through holes extending through said top wall and said bottom wall of said block and through the wall of the elongated outlet.

12. The noise-reduction device of claim 11, wherein said block is welded to the wall of the elongated outlet.

13. The noise-reduction device of claim 11, wherein said elongated reservoir is welded to said block.

14. The noise-reduction device of claim 11, wherein said through holes provide communication channels between the elongated outlet and said elongated reservoir.

15. The noise-reduction device of claim 11, wherein said through holes form a first row of channels and a second row of channels, and wherein said first row of channels is substantially parallel to said second row of channels.

16. The noise-reduction device of claim 15, wherein a gap of about 7.41 mm is provided between each channel in said first row of channels and an adjacent channel in said second row of channels that are adjacent to one another.

17. The noise-reduction device of claim 11, wherein said elongated reservoir is approximately 90 mm long.

18. A noise-reducer for an oil-lubricating system of an engine, the noise-reducer comprising:

an oil pump having a housing, the housing having an inlet and an elongated outlet having a lower side;

a muffler attached to said lower side of said elongated outlet, said muffler including:

a block having a first side and a second side, said first side of said block welded to and exteriorly of said lower side of said elongated outlet, said block including a plurality of through holes extending between said first side of said block and said second side of said block and through said lower side of said elongated outlet; and a reservoir welded to said second side of and exteriorly to said block, said reservoir including corresponding holes that are aligned with said through holes.

* * * * *